United States Patent [19]

DuBois

[11] Patent Number: 4,522,519

[45] Date of Patent: Jun. 11, 1985

[54] APPARATUS AND PROCESS FOR DROP-FEEDING SHEETS TO A TYPING OR PRINTING MACHINE INCLUDING SEPARABLE PAPER CLAMPING TRAYS

[76] Inventor: R. Clark DuBois, 332 Wakeman Rd., Fairfield, Conn. 06430

[21] Appl. No.: 445,262

[22] Filed: Nov. 29, 1982

[51] Int. Cl.[3] ..... B41J 13/10

[52] U.S. Cl. ..... 400/624; 400/629; 271/9; 271/10; 271/18

[58] Field of Search ..... 400/603, 624, 625, 629; 271/3, 4, 9, 10, 18, 37, 109, 119, 121, 122, 126, 147, 158

[56] References Cited

U.S. PATENT DOCUMENTS

| | | | |
|---|---|---|---|
| 784,789 | 3/1905 | Hartley | 271/9 |
| 1,963,445 | 6/1934 | Nicholson, Jr. | 400/624 X |
| 2,080,871 | 5/1937 | Nicholson, Jr. | 400/624 X |
| 2,267,502 | 12/1941 | Lewis | 400/624 X |
| 2,818,960 | 1/1958 | Ascoli et al. | 400/603 |
| 3,070,204 | 12/1962 | Bradshaw | 400/625 |
| 3,287,012 | 11/1966 | Woodcock | 271/18 |
| 3,309,079 | 3/1967 | Woodcock | 271/18 |
| 3,370,690 | 2/1968 | Seedorf | 271/10 X |
| 3,430,748 | 3/1969 | Parri | 400/625 |
| 3,523,685 | 8/1970 | Ehlscheid | 271/9 |
| 3,653,482 | 4/1972 | Cortona et al. | 400/603 |
| 3,727,912 | 4/1973 | Vos | 271/3 X |
| 3,765,327 | 10/1973 | Aronson et al. | 271/9 X |
| 3,963,110 | 6/1976 | Hyland et al. | 400/629 X |
| 4,050,751 | 9/1977 | Stange | 271/3 X |
| 4,078,672 | 3/1978 | Crepaldi et al. | 271/10 X |
| 4,078,786 | 3/1978 | Stange | 271/3 |
| 4,089,402 | 5/1978 | Hyland et al. | 400/625 |
| 4,138,101 | 2/1979 | Faltin | 271/119 X |
| 4,222,557 | 12/1980 | Wu | 400/625 X |
| 4,248,415 | 2/1981 | Steinhilber | 271/9 |
| 4,253,652 | 3/1981 | Steinhilber | 271/9 X |
| 4,285,607 | 8/1981 | Steinhilber | 271/9 |
| 4,326,815 | 4/1982 | Kapp | 400/625 |

FOREIGN PATENT DOCUMENTS

| | | | |
|---|---|---|---|
| 2941816 | 5/1981 | Fed. Rep. of Germany | 400/624 |
| 1454221 | 11/1976 | United Kingdom | 271/4 |

*Primary Examiner*—Ernest T. Wright, Jr.
*Attorney, Agent, or Firm*—Francis J. Bouda

[57] ABSTRACT

In the present invention, a frame, mounted above the platen of a typewriter or a word processing machine, supports a drive roller in contact with the platen. This drive roller is also in contact with a tray-moving mechanism, supported above the drive roller. A plurality of trays carried in the frame are supported above the platen so as to hold sheets of paper or envelopes vertically between trays and in alignment with the sheet insert side of the platen. When the platen is turned backward, the drive roller actuates the tray-moving mechanism, causing a tray to move, separating it from the next adjacent tray and permitting a sheet of paper which had been placed therebetween to drop into position against the platen. Thus the sheets are fed automatically against the platen when the platen rotation is reversed.

13 Claims, 25 Drawing Figures

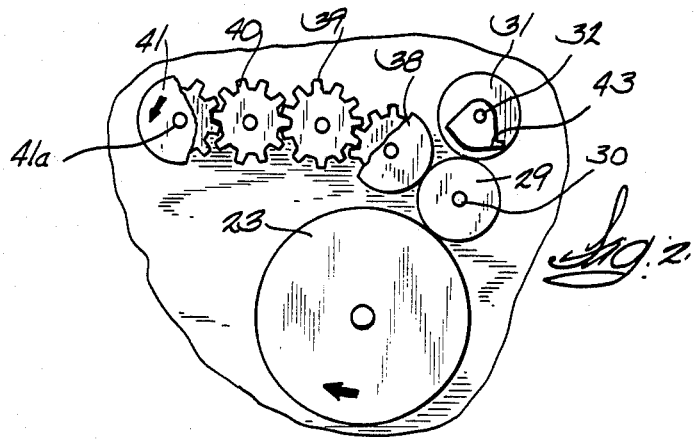
Fig. 2.
Fig. 5
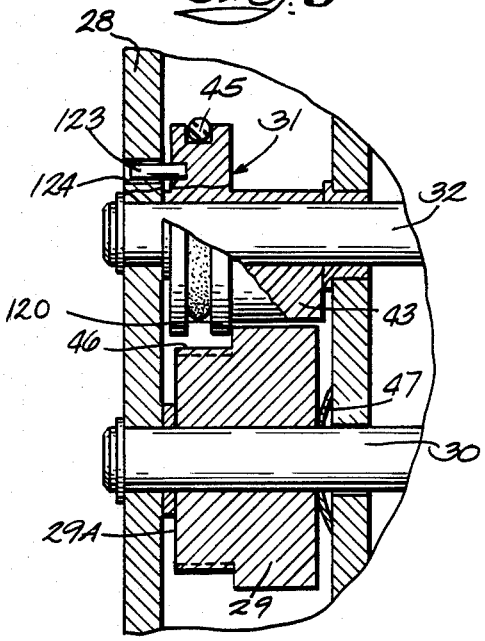
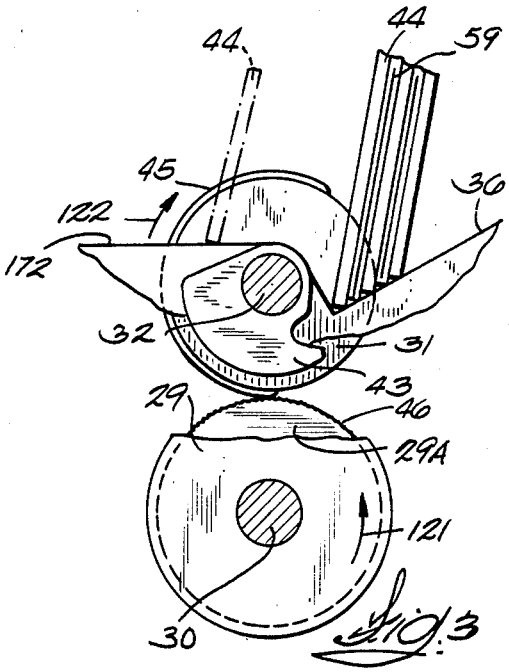
Fig. 3
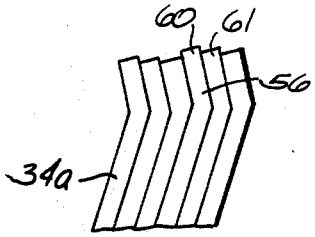
Fig. 10A
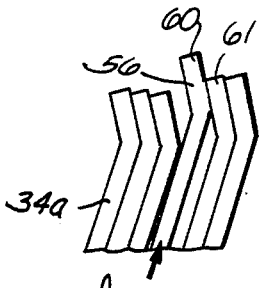
Fig. 10B
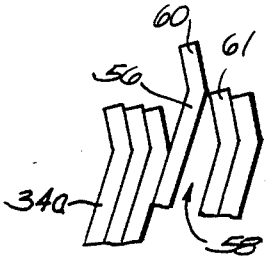
Fig. 10C

APPARATUS AND PROCESS FOR DROP-FEEDING SHEETS TO A TYPING OR PRINTING MACHINE INCLUDING SEPARABLE PAPER CLAMPING TRAYS

BACKGROUND OF THE INVENTION

Most typewriters and word processing machines are arranged for typing or printing one sheet of paper at a time. Some machines with pin-feed platens can take continuous strips of paper, but such devices are generally applied to computer and data processing machines of a more complicated construction.

The disadvantage of the single-sheet feed construction (either for letter-size sheets or for envelopes) is that the operator must manually insert the sheet at the insert side of the platen of the typewriter or printing machine.

In some word processing equipment, the rotation of the platen takes place automatically upon instructions from the word processing unit, and the sheet must be positioned on the printer ready to be advanced by the platen on instruction from the machine.

In standard typing operations, the typist must insert the sheet against the platen, rotate the platen, and bring the sheet into typing position, but this action follows the manual insertion of the sheet against the platen by the typist.

As has been stated previously, the pin-type platen advances edge-perforated sheets automatically into the typewriter, but the generally preferred method is to use individual sheet typing, which permits the utilization of differently printed letterheads, second sheets, copy paper, envelopes, labels, etc.

To spend up the operation and efficiency of the typist, the drop-sheet feeder of the present invention is applicable.

SUMMARY OF THE INVENTION

The drop sheet feeder of the present invention includes a support (which is mounted on the frame of the typewriter or printer) and which supports the frame of the drop sheet feeder above the platen of the typewriter or printer. The feeder frame supports a plurality of trays disposed generally vertically above the platen in a manner which permits individual sheets of paper to be inserted between the trays and to be held in place between the trays, either by friction, interlocking fingers, or a fixed stop to keep the papers vertically positioned above the platen until one tray is separated from the others to permit the adjacent sheet to drop against the platen. A drive wheel mounted on the feeder frame rests against the platen of the typewriter or printer and also is in contact with a rotating tray-shifting member. When the platen is rotated backwardly, the drive wheel is caused to rotate, and this, in turn, actuates the tray shift member whereby the forward-most unshifted tray is moved away from the next adjacent tray in the stack. The sheet of paper (or envelope, etc.), which had been clamped between these two trays drops against the insert side of the platen, where it may be drawn into typing position to receive impact of the typewriter elements or printer element. The trays can be manually shifted so as to insert the desired sheets into the spaces between the trays, and thus the operator may place the various types of sheets, envelopes, etc., in proper sequence in the trays.

The drop sheet feeder of the present invention does not require its own a motor or energy source, inasmuch as it receives its instruction and power directly from the platen, but if desired for independent operation, a separate motor may be utilized, and in this embodiment the drive for the feeder is not connected to the platen.

Thus the drop sheet feeder of the present invention is uncomplicated and simple to construct, is relatively inexpensive, requires no independent power source, and can be applied to a great variety of typewriters and printers without modifying the typewriter or the printer.

With the foregoing in mind, a principal object of the present invention is to provide a feeder mechanism for advancing individual sheets of paper against the platen of a typewriter or printer.

Another object of the present invention is to provide an automatic sheet feeder which enables the operator to select different styles, sizes or forms of sheets to be fed seriatim and automatically to the platen of a typing or printing machine.

Another object of the present invention is to provide a process for automatic printing or typing of separate sheets of different format.

With the above and other objects in view, more information and a better understanding of the present invention may be achieved by reference to the following detailed description.

DETAILED DESCRIPTION

For the purpose of illustrating the invention, there is shown in the accompanying drawing a form thereof which is at present preferred, although it is to be understood that the various instrumentalities of which the invention consists can be variously arranged and organized and that the invention is not limited to the precise arrangements and organizations of the instrumentalities as herein shown and described.

In the drawing, wherein like reference characters indicate like parts:

FIG. 2 is a schematic detailed view of the platen and sheetdrive mechanism of the feeder of the present invention.

FIG. 3 is a vertical cross-sectional view of one embodiment of the tray-shifting member of the feeder of the present invention.

FIG. 5 shows details of the tray-shifting mechanism.

Figure 7:
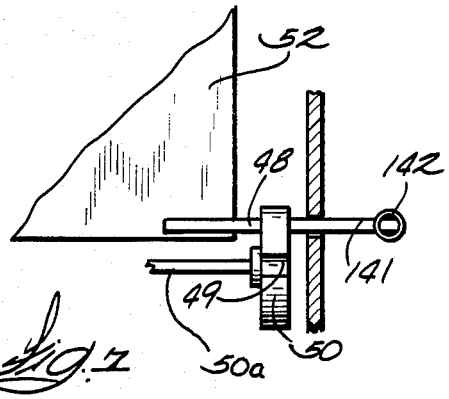

FIG. 7-A is a top view of one form of pin-guide of FIG. 7.

Figure 8:
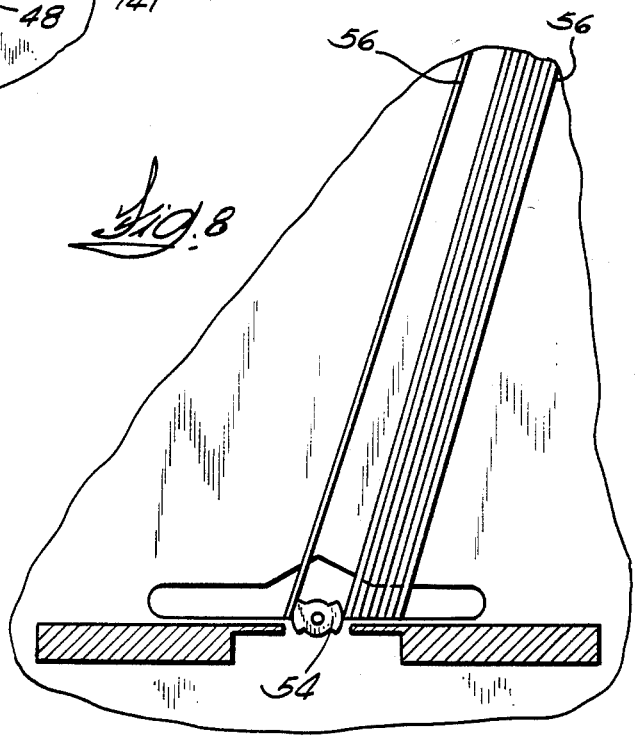
Figure 9A:
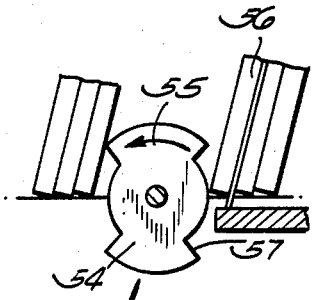
Figure 9B:
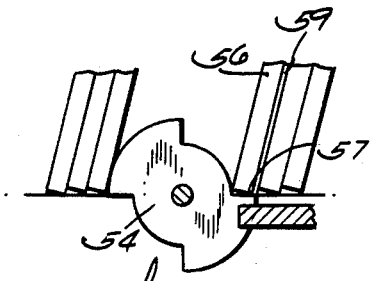
Figure 9C:
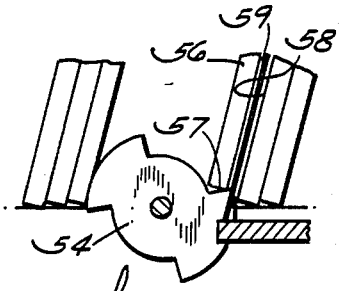
Figure 9D:
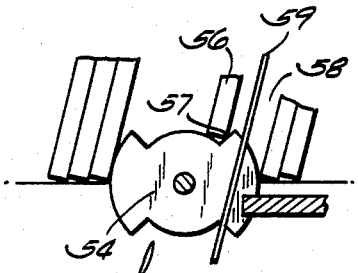
Figure 9E:
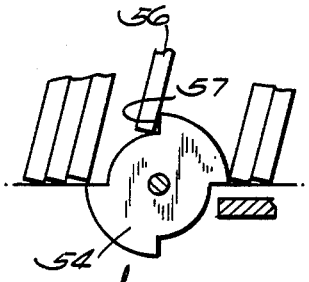
Figure 9F:
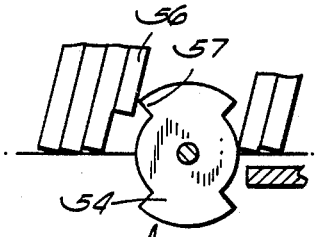
Figure 9G:
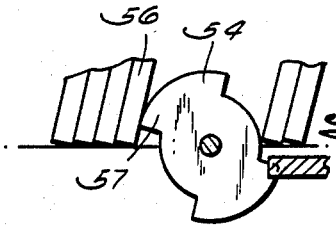

FIG. 8 is a stylized view of a cross-section of another form of tray-shifting mechanism.

FIGS. 9-A to 9-G inclusive illustrate the rotary tray-shifting mechanism of FIG. 8.

FIGS. 10-A, B and C illustrate the modified form of the tray-shifting mechanism to create a space between adjacent trays and release the sheet clamped therebetween.

Figure 11:
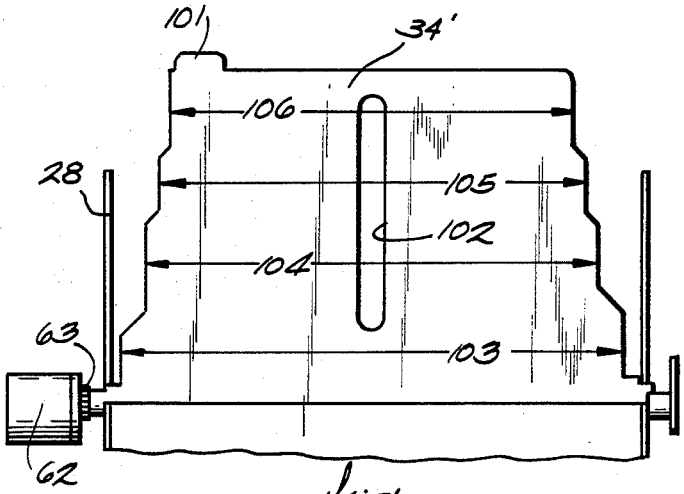

FIG. 11 illustrates a modified version of the sheet feeder of the present invention wherein a self-contained motor can be utilized to move the trays, independently of the friction drive and platen combination previously referred to.

Figure 12:
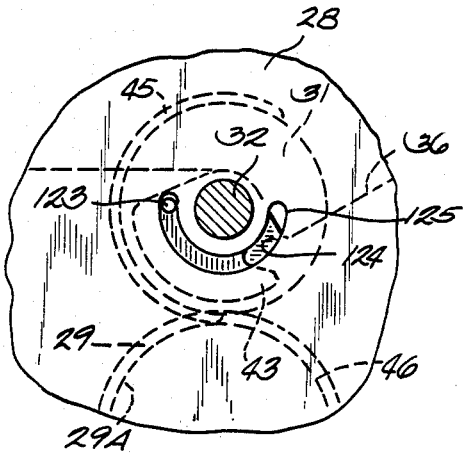

FIG. 12 illustrates details of the tray-shifting mechanism of FIG. 3.

Figure 13:
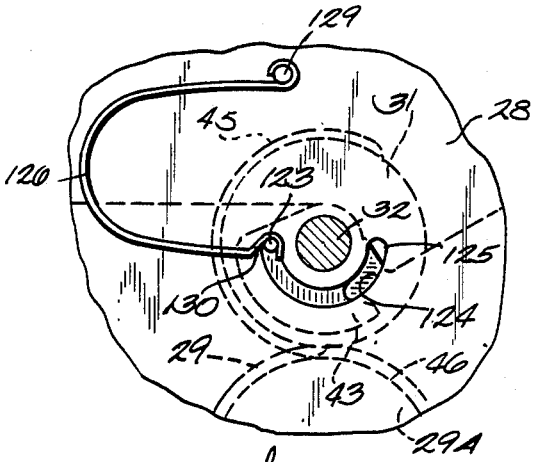

FIG. 13 illustrates a modification of the shifting mechanism of FIG. 12.

Figure 14:
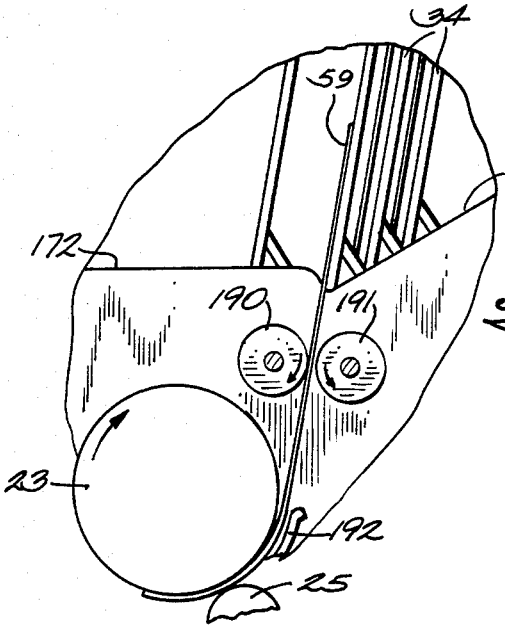

FIG. 14 illustrates additional means for insuring that sheets will reach the insert side of the platen.

Figure 1:
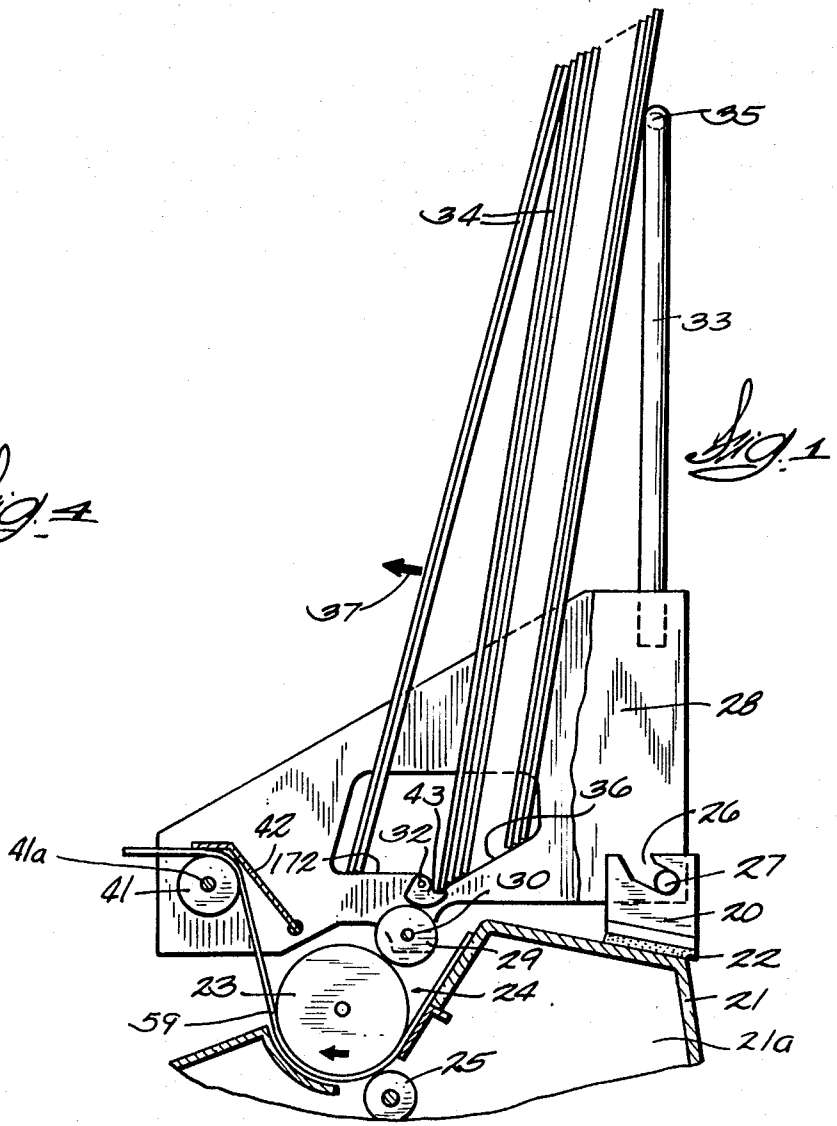
FIG. 1 is a side vertical cross-sectional view of the drop sheet feeder of the present invention.
Figure 4:
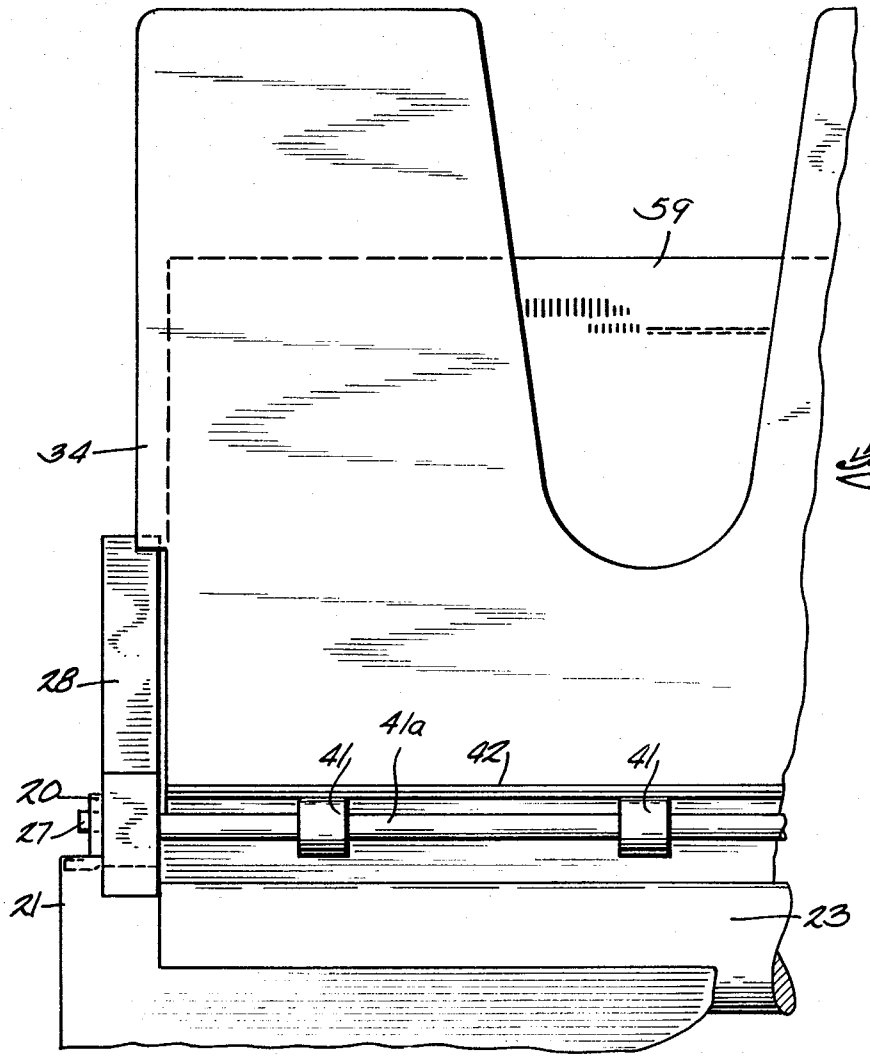
FIG. 4 is a fragmentary view of the platen and drive wheel mechanism of the present invention.
Figure 7A:
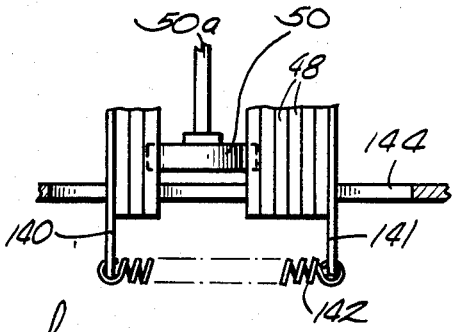
FIG. 7 is a fragmentary cross-sectional view of the transfer wheel shown in FIG. 6.
Figure 15:
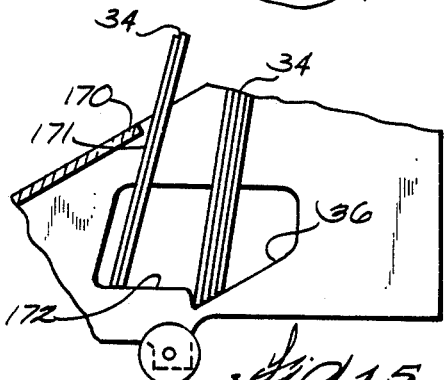

FIG. 15 is a fragmentary schematic view of the tray support similar to FIG. 1.

Figure 16:
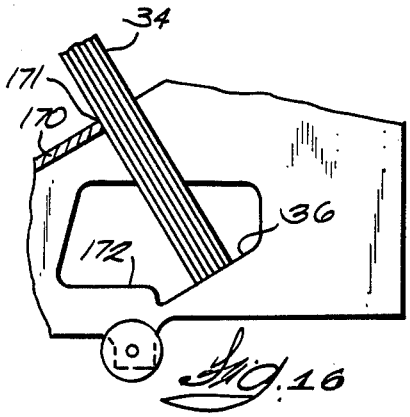

FIG. 16 is a view similar to FIG. 15 showing the procedure to re-set the trays.

In FIG. 1, a bracket 20 is supported on the chassis 21 of a typewriter or printing machine 21-*a* as, for instance, by a strip of foam tape 22, which has adhesive on both sides and which can be positioned on the chassis of the typewriter 21-*a* to hold the bracket 20 in appropriate position to support the drop sheet feeder above the platen 23 of the printing machine 21-*a*. The platen 23 is spaced from the chassis 21 and an insert area 24 is defined between the platen 23 and the chassis 21 to receive a sheet of paper 59 where it is grasped between the platen 23 and a friction roller 25 so that the sheet 59 may be guided around the platen 23 and into operative juxtaposition to the typewriter keys or printer element.

The bracket 20 has a slot 26 constructed and arranged to receive the support pins 27 of the feeder frame 28.

Thus the entire feeder frame 28 with its wheels 29, 38, 41; gears 39–40; and trays 34, etc., may be removed from the typewriter or printer 21-*a*, merely by lifting frame 28 and the pins 27 out of the slot 26.

The frame 28 supports a knurled wheel (or wheels) 29 on the shaft 30 in a position whereby the wheels 29 rest in operative contact with the platen 23 when the pins 27 are in the slot 26. The weight of the drop feed mechanism causes the wheels 29 to be in close contact with the platen 23 so that when the platen 23 rotates, the wheels 29 will also rotate.

The knurled wheels 29 operate in conjunction with the wheel 31 (supported on the shaft 32) as will be seen more clearly when considering FIGS. 5, 12 and 13.

Fastened to the frame 28 is a brace or bracket 33 which extends vertically upwardly above the frame 28 and against which a plurality of sheet-guiding trays 34 are caused to rest, as against the portion 35 of the support 33.

The bottom edges of the trays 34 are supported on a sloping surface 36 which can be seen more clearly in FIGS. 3, 15 and 16.

The tops of the trays 34 may be drawn forward by the machine operator in order to load the sheets of paper 59 therebetween (in the direction of the arrow 37 shown in FIG. 1). As will be described hereinafter, the bottom of the trays 34 also shift toward the left (FIG. 1) onto the surface 172 to drop the sheets 59, as required, against the platen 23 of the machine. To reset the trays 34, the operator merely pushes the bottom edges of the trays 34 backwardly into position where the bottom edges are supported on the sloping surface 36. (See also FIGS. 15 and 16).

The trays 34′ may have tabular tops 101 (as shown in FIG. 11) for easy manipulation, and they may also have slots or cutouts 102′ therein so that the sheets held between may be visible.

The trays 34′ may also have the side edges shaped as shown in FIG. 11, with a bottom portion 103 approximately $9\frac{1}{2}''$ wide, an intermediate portion 104 approximately $8\frac{1}{2}''$ wide, another intermediate portion 105 approximately $8\frac{1}{4}''$ wide, and an upper portion 106 approximately 8″ wide. This arrangement enables the operator to center the sheets 59 laterally between the trays 34′. When the sheets 59 (or envelopes) are quickly inserted between the trays 34′, the lateral location will not be precise. After the sheets 59 or envelopes are placed between the trays 34′, the operator may bring one finger along the right-hand edge of the trays 34′ and another finger along the left-hand edge of the trays 34′, and by tapping the edge of the sheets 59 or envelopes, the items may be centered within the trays 34′. The lower-portion 103 is the width of a No. 10 size envelope (approximately $9\frac{1}{2}''$ long), the portion 104 is the width of an $8\frac{1}{2}'' \times 11''$ sheet of paper (the usual size for U.S. business purposes). The portion 105 is $8\frac{1}{4}''$ wide, which is the approximate dimension of an international A-4 sheet of paper, and the upper portion 106 is the 8″ width of an $8'' \times 10''$ sheet of paper used for governmental purposes.

The trays 34 may also be made in different lengths to accommodate letter-size paper or legal-size paper, and may also be curved, bowed, or shaped so as to support that portion of a sheet 59 which extends upwardly beyond the tray 34.

referring now to FIG. 2, the gear-train mechanism and drive-wheel mechanism shown therein illustrates how the knurled wheel 29 and the wheel or rotator 31 are all in contact. Additionally, there is provided a series of wheels or rotators 38, and 41 operatively interconnected (as by gears 39–40 or suitable drive mechanism) so as to guide the paper 59 when it exits from the machine to a stacking tray or other receiving platform (not shown). The last rotator 41 in the train of rotators 29, 38, 41 is also operatively disposed adjacent a paper guide 42, which guides the paper 59 away from the platen 23 and prevents its interrupting the operation of the drop sheet feeder.

In FIGS. 3, 5, 12 and 13, there is illustrated a form of tray-shifting mechanism, wherein a finger 43 is carried by the rotator 31 so that when the rotator 31 turns, the finger 43 lifts the forward-most tray 44 away from the stack of trays 34, causing an opening to appear between it and its next adjacent tray 34, and permitting the sheet 59 held between those trays 44, 34 to drop against the platen 23. The dotted line positions shown in FIG. 3 illustrate how the tray 44 is lifted up and away from the stack of trays 34 to create the opening between it and the next adjacent tray 34.

Referring now to FIGS. 5, 12 and 13, the tray shifter operation can be more clearly understood.

The knurled wheel 29 rotates on the shaft 30 (see FIG. 5) and has a face contact (along line 120) with the face of an adjacent wheel 31. A spring 47 urges the wheel 29 into face contact with the wheel 31, and thus when the wheel 29 rotates, the wheel 31 tries to rotate along with it but with a limited torque because spring 47 exerts a light force.

Along a portion of the peripheral surface of the wheel 31, a portion 45 extends radially beyond the outer diameter of the wheel 31. It may be made of a high friction material such as a rubber ring or the like. In FIG. 5, it is illustrated as an "O" ring, but, as it will be clearly seen in FIGS. 3, 12 and 13, only a portion of the circumference of the wheel 31 is so formed.

During normal operations of the platen 23, the knurled wheel 29 rotates in the direction of the arrow 121 (shown in FIG. 3) and constantly drives the tray shifter wheel 31 in the direction of the arrow 122 because the toothed surface 46 of the wheel 29 pushes the raised portion 45 in the direction of the arrow 122.

A pin 123 which is fastened to the wheel 31 travels in slot 124 and prevents the wheel 31 from turning in the direction of the arrow 122 any farther than the pin 123 can move in the slot 124.

The light friction between the face of the wheel 29 and the face of the wheel 31, forced into contact by the light spring 47, will cause the wheel 29 to tend to rotate. When the wheel 29-A rotates in the direction opposite to the arrow 121, shown in FIG. 3 (as when the platen 23 reverses its direction), the raised portion 45 of the wheel 31 is caused to rotate in the direction opposite to the arrow 122 shown in FIG. 3.

There is a substantial force exerted between the wheel 29 and the raised portion 45 of the wheel 31, sufficient to cause the finger 43 to lift the bottom edge of the tray 44 up and over as shown in FIG. 3.

When the raised portion 45 has moved past the surface 46 of the wheel 29-A, only the light face-to-face friction is exerted on the wheel 31 and its continued rotation is stopped when the pin 123 reaches the opposite end 125 of the slot 124. At this point, the tray shifting has been completed, and any continued rotation of the wheel 29-A merely causes a light friction drag at line 120 (but causes no further rotation of the wheel 31).

This tray shifting sequence is accomplished within approximately 6 backspacing motions of the typewriter or printer, and when the platen 23 resumes its normal forward rotation, the friction wheel 29 rotates in the other direction and the reverse action turns the wheel 31 in the direction of the arrow 122, causing it to be reset or to reach its "home" position.

In FIG. 13 there is illustrated a mechanism which replaces the face contact of the wheels 29 and 29-A and also the spring 47.

A light hair spring 126 is fastened to the side frame 28 as at 129 with its outer end 130 fastened to the stop pin 123. The spring force on the pin 123 tends to rotate the wheel 31 so that the raised portion 45 may contact the toothed surface 46 of the wheel 29 at either end of its rotation.

In operation, the spring 126 causes slight contact of the raised portion 45 but not sufficient movement to cause the wheel 31 to operate. It is to be understood that the raised portion 45 may be a rubber surface or some other rigid material. For instance, if the toothed surface 46 of the wheel 29 is itself a elastomer or rubber, then the raised portion 45 may be metal or some other rigid material.

Figure 6:
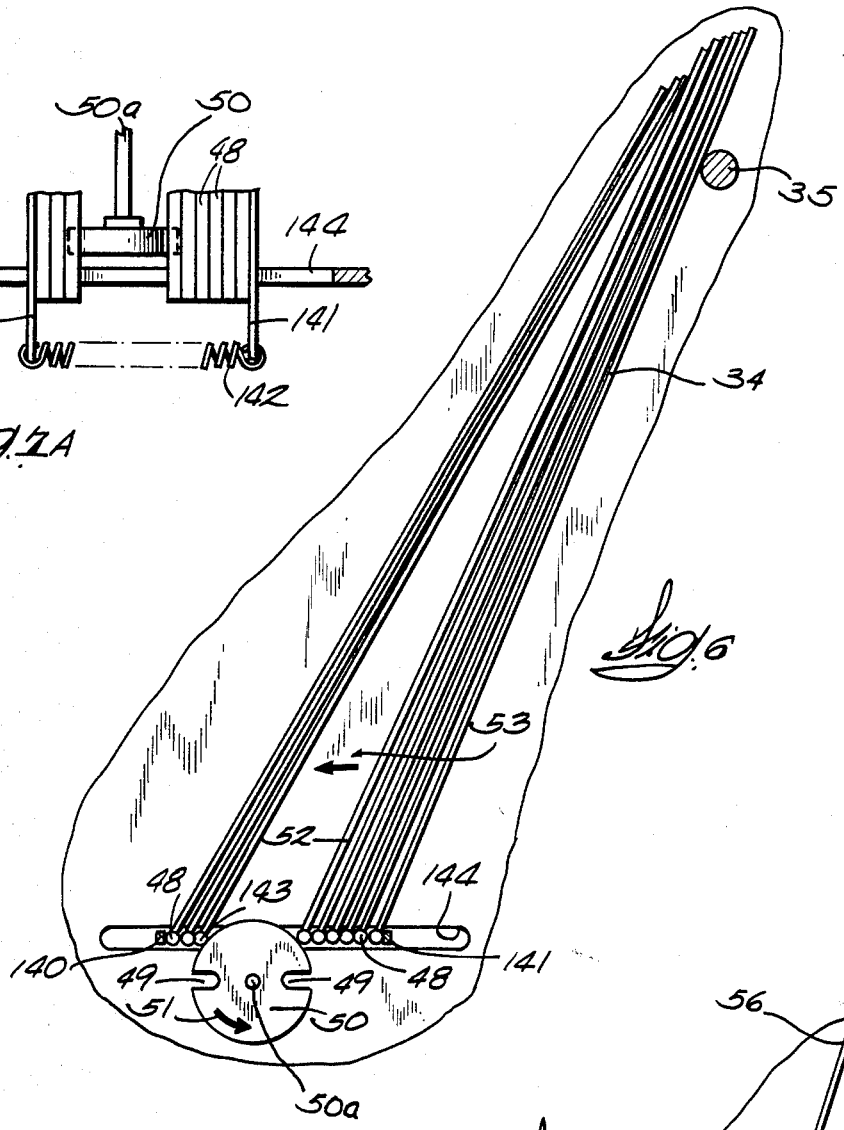
FIG. 6 is a stylized vertical cross-sectional view of the modified form of the tray-shifting mechanism.

In FIGS. 6 and 7, there is illustrated a modified form of tray shifting device wherein the bottom edges of the trays 34 have pins or trunnions 48 extending laterally so as to bring them in contact with the slots 49 in a geneva wheel 50 supported on shaft 50-*a*. As the wheel 50 is rotated in the direction of the arrow 51, the pins 48 of the trays 52 will drop into the slots 49 and will be moved in the direction of the arrow 53 as the wheel 50 rotates.

It is preferred that the pins 48 of the end trays 34 of the group extend as at 140 and 141 in FIG. 7-A, with a spring 142 or some other force biasing the trays 34 toward the wheel 50. This will insure that pins 140–141 are always in contact with the geneva wheel 50 so as to insure entrance and exit from the slots 49. As the geneva wheel 50 rotates in the direction of the arrow 51, the pin 143 is forced out of the slot 49 because all of the pins 140–141 are guided in a guide slot 144.

It is to be understood that the guide slot 144 may be inclined upwardly away from the axis of the geneva wheel 50 and that gravity or some other force may be used to urge the pins 140–141 on each side into contact with the geneva wheel 50, and that it is not necessary to use a biasing spring 142 to accomplish this end result.

In FIGS. 8 and 9, there is illustrated still another form of tray-shifting mechanism, wherein a shaped wheel 54 not only lifts an appropriate tray 56 and moves it forwardly, creating an opening between it and an adjacent tray 56, but also separates and holds the trays 56 apart during the operation.

As the wheel 54 (which is a modified form of the geneva wheel 50 shown in FIGS. 6 and 7) rotates in the direction of the arrow 55, the tray 56 is caught on the shoulder 57 and lifted upwardly as shown in FIGS. 9-B, C, D and E, creating the opening 58 (seen particularly in FIG. 9-D), permitting the sheet 59 to drop against the platen 23 of the printer 21-*a*.

FIGS. 10-A, B and C illustrate a form of tray 34-*a* wherein a portion 60 is bent or shaped so that the trays 34-*a* may be kept closely adjacent each other at the upper end but when the wheel 54 rotates, as previously described; it not only lifts the tray 56 upwardly, but also the bent portion 60, riding against the bent portion of the adjacent tray 61, causes the opening 58 to be created not only at the lower end of the trays 34-*a* which are in contact with the wheel 54, but also at the upper end near the bent portions 60.

In FIG. 11, there is illustrated an arrangement whereby a motor 62 is mounted on the frame 28. A transfer wheel and gear 63 operate in substantially the same manner as the wheel 31 or geneva gear 50, or rotary wheel 54, previously described. In this case, the operation of the drop sheet feeder is not under the control and instruction of the rotary platen 23 but can be managed independently. It is preferred that the motor 62 will get its instructions to turn the wheel and gear 63 from an appropriate timing mechanism (not shown) when instruction is fed by the word processing equipment (not shown), or by the operator who may press the button (not shown) or operate a switch (not shown) to cause the motor 62 to function.

In FIGS. 15 and 16, there is illustrated a simple mechanism by which the trays 34 can be reset to their original position. An edge 170 of the cover or frame of the feeder provides a stop against which the trays 34 may be pivoted so as to reset the bottom edges on the inclined surface 36.

As shown in FIG. 16, the upper end of the trays 34 are moved forwardly by the operator causing the forward-most tray 34 to contact the edge 170, as at 171, when the operator pulls the upper-end of the trays 34, the bottom edges slide from the surface 172 back to the inclined surface 36.

There is illustrated in FIG. 14 a modified arrangement whereby a pair of advancing rollers 190 and 191 receive the falling sheet 59 between them and under positive driving action carry the sheet 59 downwardly against the guide surface 192 and into position between the platen 23 and the drive roller 25. These additional rollers 190–191 provide a paper drive when the insert area of the platen 23 is not disposed on the rearward side of the platen 23, as shown in FIG. 14. In the arrangement shown in FIG. 14, a falling sheet 59 may not be caught by the nip between the platen 23 and the drive roller 25, and this mechanism, as shown in FIG. 14, assures proper entry of the paper 59 into the drive mechanism of the printer 21-*a*. It also tends to reduce the side bounce of the sheets 59 as the paper 59 falls from the feeder into the printer 21-*a*.

It is also to be understood that the friction drive of the feeder can be replaced by a gear drive connected to most printers or typewriters. Many printers have an open gear at one end of the platen to drive sprocket or pin-type feeders, and a connection between the feeder and the printer can use this mechanism.

It is also to be understood that the exit roller shaft 41-*a* preferably extends across the face of the feeder as a cross-shaft so as to insure that both sides turn at the same time.

Although the embodiment shown in FIGS. 1, 2 and 3 drive the bottom edge of the trays 34 in only one direction, the embodiments shown in FIGS. 6–7 and 8–9 enable the bottom edge of the trays 34, 56 to be driven in either direction in the event that it is desirable to do the shifting both from right to left as well as from left to right.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what I claim as new and desire to protect by Letters Patent are the following:

1. In a drop-sheet feeder for a printing machine having a platen, a frame supported by the printing machine and disposed above the platen, a plurality of trays at all times supported generally vertically on said frame, a first support surface for the lower ends of the trays, a second support surface for the lower ends of the trays, and a tray shifter means for moving the lower ends of the trays from the first support surface to the second support surface.

2. The drop-sheet feeder of claim 1 including drive mechanism connected to the tray shifter means.

3. The drop-sheet feeder of claim 2 wherein said drive mechanism is arranged for operative engagement with the platen of the printing machine.

4. The drop-sheet feeder of claim 3 wherein said drive mechanism activates said tray shifter means only when the platen is operated in a reverse direction.

5. The drop-sheet feeder of claim 2 wherein said drive mechanism and said tray shifter means include a slip-gear drive and a lifting finger arranged so that the finger will move a tray from the first support surface to the second support surface upon command, whereby to create a space between the moving tray and its adjacent tray.

6. The drop-sheet feeder of claim 5 including a pivot about which the plurality of trays may turn, whereby to cause the lower end of the trays to move from the second support surface back to the first support surface when the upper ends of the trays are moved forwardly.

7. The drop sheet feeder of claim 1 wherein the second support surface is horizontal and the first support surface is at an angle to the second support surface, and the first support surface terminates adjacent to and vertically beneath the second support surface.

8. The drop-sheet feeder of claim 1 wherein said tray shifter means includes a wheel having at least one slot for engaging a tray and moving said tray from the first support surface to the second support surface when the wheel turns.

9. The drop-sheet feeder of claim 8 wherein each tray has at least one pin extending from the lower end thereof for engagement in the slot of said wheel.

10. The drop-sheet feeder of claim 1 wherein the side edges of each tray are stepped to provide sheet-centering guides therebetween, the bottom steps defining the widest guides, and the upper steps defining the narrowest guides.

11. The process for drop-feeding sheets to a platen of a printer, which process includes arranging a plurality of trays vertically above the platen, separating the upper ends of the trays, placing sheets between the trays, bringing the upper ends of the trays together with the sheets in close contact with the trays whereby to prevent the sheets slipping downward between the trays, moving the lower end of a first tray away from the adjacent tray to create a space therebetween and permit the sheet which had been held between the said trays to drop to the platen of the printer.

12. The process of claim 11 which includes moving all of the trays seriatim whereby sequentially to release the sheets supported by the trays.

13. The process of claim 12 which includes bringing the first tray against a pivot and rotating all of the moved trays about the pivot so that the lower ends of the trays return to their original position.

* * * * *